US005149076A

United States Patent [19]

Stenz

[11] Patent Number: 5,149,076

[45] Date of Patent: Sep. 22, 1992

[54] ENVELOPE FEEDER WITH ADJUSTABLE CONSTANT OVERLAP

[76] Inventor: Reinhard Stenz, Brunnenwiesenstrasse 4, CH-8108 Dällikon, Switzerland

[21] Appl. No.: 381,737

[22] PCT Filed: Jun. 13, 1989

[86] PCT No.: PCT/CH88/00196

§ 371 Date: Jul. 10, 1989

§ 102(e) Date: Jul. 10, 1989

[87] PCT Pub. No.: WO89/04805

PCT Pub. Date: Jun. 1, 1989

[30] Foreign Application Priority Data

Nov. 27, 1987 [CH] Switzerland ..... 04619/87

[51] Int. Cl.[5] ..... B65H 5/22; B65H 3/34; B65H 29/66

[52] U.S. Cl. ..... 271/2; 271/5; 271/6; 271/99; 271/104; 271/225; 271/265; 271/202; 271/216

[58] Field of Search ..... 271/2, 3, 4-6, 271/99, 225, 184, 265, 258, 216, 202, 104

[56] References Cited

U.S. PATENT DOCUMENTS

| | | | |
|---|---|---|---|
| 2,862,709 | 12/1958 | Labombarde | 271/99 |
| 3,051,333 | 8/1962 | Richert et al. | 271/2 |
| 3,146,902 | 9/1964 | Voelker | 271/2 |
| 3,522,943 | 8/1970 | Swanson | 271/6 |
| 3,900,115 | 8/1975 | Kumagai | 271/3.1 |
| 3,907,278 | 9/1975 | Jaton | 271/11 |
| 3,926,427 | 12/1975 | Moksnes et al. | 271/99 |
| 4,062,532 | 12/1977 | Peter et al. | 271/3.1 |
| 4,361,317 | 11/1982 | Lapp-Emden | 271/3.1 |
| 4,369,959 | 1/1983 | Hornbuckle | 271/6 |
| 4,655,131 | 4/1987 | Krämer | 271/2 |

FOREIGN PATENT DOCUMENTS

| | | | |
|---|---|---|---|
| 10177651 | 4/1986 | European Pat. Off. . | |
| 13347147 | 11/1982 | Fed. Rep. of Germany . | |
| 75752 | 4/1986 | Japan | 271/6 |
| 2132174 | 4/1984 | United Kingdom . | |

*Primary Examiner*—Robert P. Olszewski
*Assistant Examiner*—Steven M. Reiss
*Attorney, Agent, or Firm*—Wegner, Cantor, Mueller & Player

[57] ABSTRACT

An envelope feeder which can be used on virtually all existing printing machines without the need to synchronize the latter comprises a low-pressure chamber (3), a perforated conveyor belt (4) and an adjustable barrier (6). An overlap with a very small overlap length (5) is thereby achieved. The envelope feeder can therefore be used not only for small envelopes (1), but also for those with very narrow flaps (2).

5 Claims, 3 Drawing Sheets

ENVELOPE FEEDER WITH ADJUSTABLE CONSTANT OVERLAP

The invention in question deals with the fundamental problem of how to feed envelopes for printing to a printing machine without an interruption in work or a tailback coming about. If, for example, a pile of envelopes is placed in front of a printing machine to be printed, then it will lift these envelopes individually in the printing cycle, e.g. by means of a suction arm, and carry out the actual printing process. In order to be able to place further envelopes from additional boxes, the machine would have to be switched off. In order to prevent this, one is forced to construct envelope feeders which continuously feed the printing machine with envelopes without the printing machine having to be interrupted.

According to the current state of the technology, there have up to now been three different solutions of this problem, none of which was in a position to satisfy completely.

1st. Variation

The printing machine and the envelope feeder are built together as a single compact machine. There is thus no possibility of use on other printing machines.

2nd. Variation

Suction rods or suction plates take away the envelopes individually, which then have to go to the printing machine synchronously. The synchronous device existing on the market however only fits one printing machine available in the trade and is thus not compatible with others.

3rd. Variation

A further envelope feeder is in fact partly compatible, but works with a rubber band, which results in a great division coming about in the overlap. In addition, this envelope feeder feeds the envelopes, as do all other feeders mentioned, in a longitudinal direction, i.e. the envelopes have the short side at the front and the flap is not at the front, but on the side. This means that this envelope feeder cannot be used for sheet-fed offset presses, which are intended for sheets of A3 format. The envelopes cannot be taken on by the overlap feeder of this printing machine, as the width of the front smaller side is too small. This is above all true for the C6 envelope.

The gap in the market mentioned here can now be filled with the invention in question, as an envelope feeder has been constructed which can also transport the envelopes transversely, i.e. with the broader side in front. Thus an envelope feeder has been constructed which can be used for virtually all printing machines.

Figure 1A:
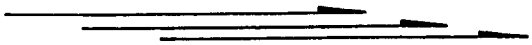

FIG. 1*a* is a side elevational view of a stack of envelopes having narrow flaps with a predetermined overlap distance from which an envelope feeder can feed envelopes in accordance with the present invention.

Figure 1B:
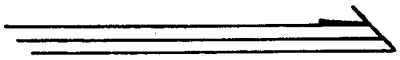
Figure 1C:
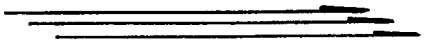
Figure 1D:
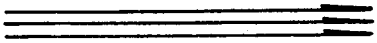

FIG. 1*b* is a side elevational view showin the stack of envelopes when the overlap distance is too large;

FIG. 1*c* is a side elevational view showing the stack of envelopes when the overlap distance is too small;

FIG. 1*d* is a side elevational view showing what happens when the overlap distance is too small as in FIG. 1*c;*

Figure 2A:
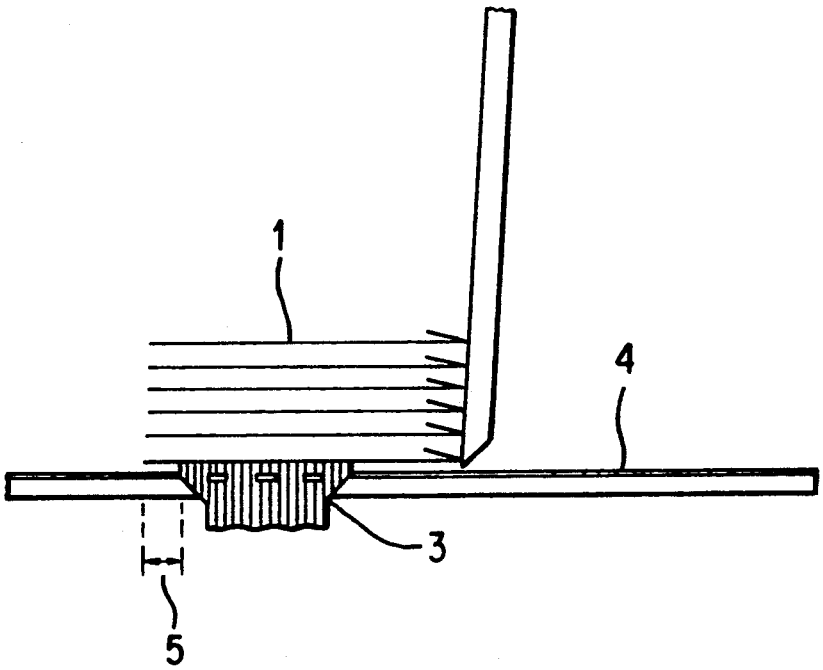
Figure 2B:
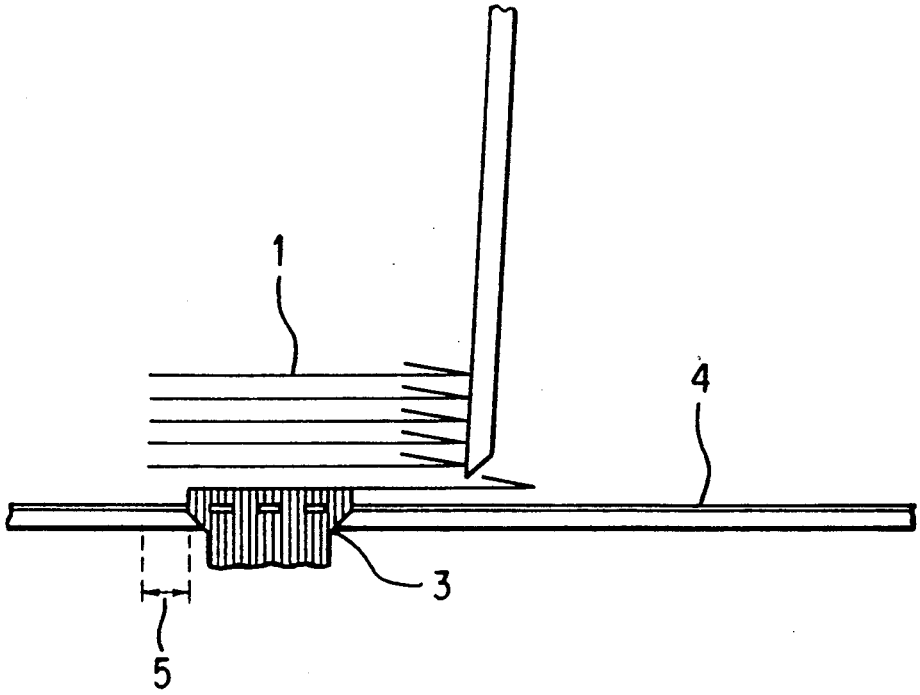
Figure 2C:
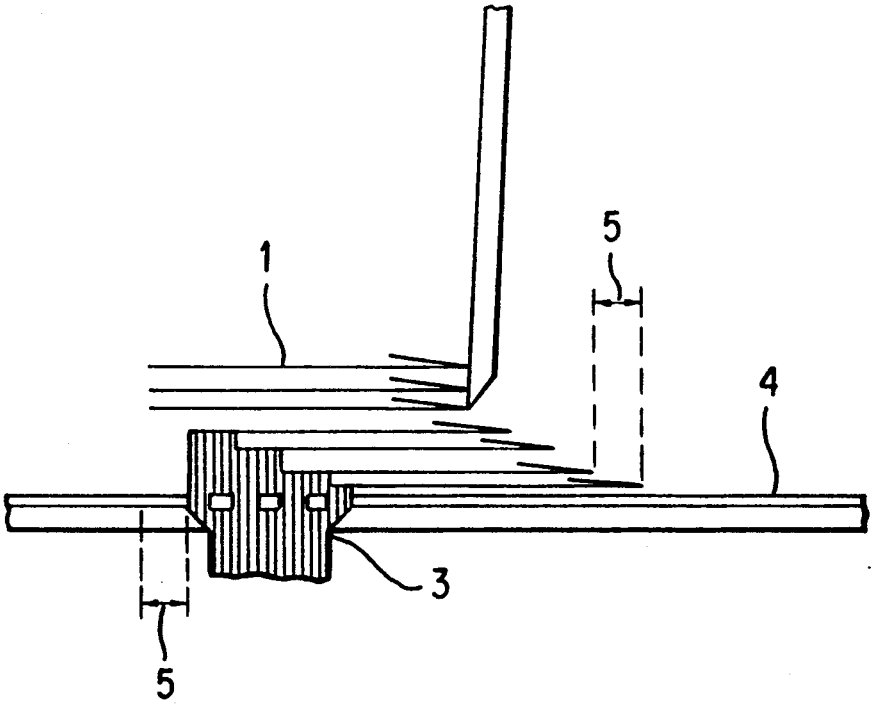
Figure 3B:
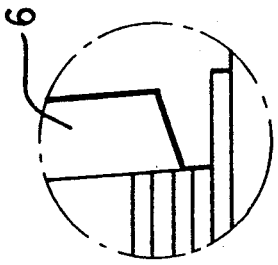
Figure 3A:
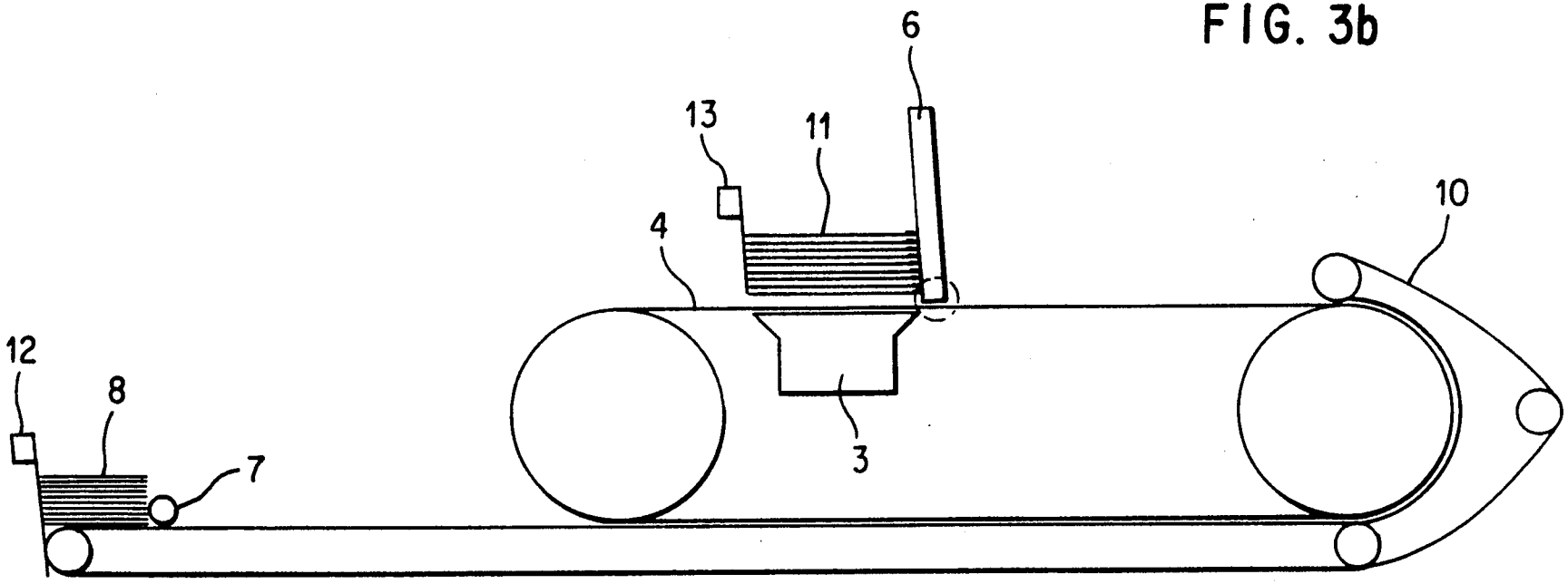

FIG. 2*a* is a side elevational view of the lateral feed means of an envelope feeder in accordance with the present invention;

FIG. 2*b* is a side elevational view as in FIG. 2*a* just as the bottom envelope is moved from the stack;

FIG. 2*c* is a side elevational view as in FIG. 2*a* showing several envelopes moved from the stack with a predetermined degree of overlap;

FIG. 3*a* is a side elevation view of an envelope feeder in accordance with the present invention; and FIG. 3*b* is an enlarged partial view of FIG. 3*a*.

In order to be able to transport the envelopes with the broad side and thus the flaps at the front, without the following envelopes falling under their flaps when being pushed together, it was firstly necessary to solve the problem of even being able to construct an envelope feeder which works very reliably with an overlap distance of, for the sake of example, 2 cm, and only has very low values of deviation. As is shown in FIG. 1, this is above all necessary for self-adhesive envelopes 1, which only have a very narrow flap 2 of about 2 cm. In FIG. 1*b*), it is shown what happens when the overlap distance, as shown in FIG. 1*a*), is too large. The following envelopes 1 are then erroneously pushed under the flap 2 of the previous envelope during the formation of the storage pile. FIG. 1*d*) shows how the envelopes come to lie on top of one another if, as in FIG. 1*c*), the overlap distance chosen is too small.

Tests have shown that such small overlap distances with only quite minimal deviations cannot be achieved with a rubber band in which the overlap distance is determined by the momentary frictional force. The invention consists of the fact that the necessary precision and reliability are achieved with the help of a low-pressure chamber 3 (cf. FIG. 2), a perforated conveyor belt 4 and an adjustable barrier 6.

FIG. 2*a*) shows how the bottom envelope is sucked by the low-pressure chamber 3. This results in it remaining on the conveyor belt 4 and being pulled away from it. As soon as the hindmost edge of the envelope has moved sufficiently to the right, the suctional effect can also be exerted on the second envelope from the bottom. This threshold situation is demonstrated exactly in FIG. 2*b*), and in FIG. 2*c*) the second envelope from the bottom has already been affected by this suctional effect and is also going to the right together with the bottom envelope, whereby the second envelope is displaced to the right by the overlap distance 5 in comparison with the first envelope. When adjusting the underpressure, it is therefore important for the right strength to be dosed. If the underpressure is too high (e.g. 50 mbar), two envelopes will be pulled away at the same time, whereas in the case of less than half of this value flawless functioning is guaranteed.

FIG. 2 shows clearly how the overlap distance 5 can be adjusted very simply, as it corresponds simultaneously to the distance between the left edge of the low-pressure chamber and the left edge of the envelope 1. This overlap distance can be deliberately and precisely varied by the pile of envelopes being displaced to the left or the right. This can be carried out very simply with the adjustable barrier and the simultaneous stripper 6 (cf. FIGS. 3*a* and 3*b*), as this barrier or stripper 6 can be adjusted to the left or right and then be fixed in any position.

In order to guarantee a certain security for the fact that not too many envelopes are pulled over to the right at the same time, the stripper 6 can also be adjusted as regards its height and again be fixed here in any position. The task of the envelope feeder is now to form a storage pile of envelopes 8 (cf. FIGS. 3*a* and 3*b*) from which the overlap feeder of the printing machine can at any time remove envelopes to be printed. This storage pile 8 is achieved by further envelopes continuously being pushed in at the bottom of one pile and the pile thus becoming larger if the envelopes are not permanently removed again at the top by the overlap feeder of the printing machine. In order that this storage pile can nevertheless not become too large, it is provided with a light barrier 12, so that envelope feeding can be controlled electronically in this way. In addition, a photocell 13 can be installed in the refill pile 11, so that a signal is heard when refilling is necessary. The retaining roll 7 immediately in front of the storage pile 8 is also a part of this invention. It makes sure that any air is pressed out of the envelopes. This addition can remove an old evil which has existed up to now in machines. As soon as the excess air was pressed out of the envelopes in printing, the paper began to wobble and thus the printing was blurred and smeared. The above mentioned retaining roll 7 makes sure from the outset that no more air exists during the printing process and thus high printing precision comes about during the first run.

In order that the envelopes can even be pushed into the storage pile 8, it is necessary to make sure that in the overlap the following envelope is not above, but below the previous one, so that the following envelopes are really pushed bottom first into the storage pile. This is achieved by the overlapped envelopes being turned in the same manner as this is carried out in envelope feeding machines already known. A second conveyor belt 10 is run at exactly the same speed underneath the first conveyor belt 4. The envelopes then come to rest on the second conveyor belt 10 underneath the first conveyor belt 4 after the first guide roll.

Thus it can be stated that the invention in question has succeeded in constructing an envelope feeder which is easy to adjust and no longer has the disadvantages of existing machines, as it can be used for virtually all printing machines without synchronization with the printing machines being necessary and because it is possible, thanks to an exactly adjustable precise overlapping, to transport the envelopes on the conveyor belt with the broadside first.

I claim:

1. An envelope feeder for a printing machine adapted to feed envelopes from a refill pile in which the envelopes are stacked such that each flaps is folded over an upper face of the envelope to a storage pile in a stream of overlapped envelopes, said feeder comprising:

lateral feed means for laterally feeding envelopes from the refill pile with the lateral flap edge leading and with an essentially constant predetermined degree of envelope flap overlap, said lateral feed means including a first conveyor belt led around a guide roller, a stripper movably disposed above the first conveyor belt to contain the refill pile, and suction means disposed below the top portion of the first conveyor belt and the stripper for applying constant suction to a bottom envelope in the refill pile so as to draw the bottom envelope from the refill pile and hold it to the first conveyor belt, wherein the distance between the stripper and a top portion of the first conveyor belt is adjustable, wherein the longitudinal position of the stripper is adjustable to change the predetermined degree of envelope flap overlap in the stream of envelopes, and wherein the first conveyor belt is provided with perforations so as to be air-permeable; and means for turning over the envelopes before the envelopes reach the storage pile, said means including a second conveyor belt.

2. An envelope feeder as claimed in claim 1, further comprising air extrusion means for extruding air from the envelopes in the stream of envelopes.

3. An envelope feeder as claimed in claim 2, wherein said air extrusion means is a rotatable retaining roller.

4. An envelope feeder as claimed in claim 1, further comprising storage pile supervision means for supervising the height of the storage pile and controlling the speed of the first conveyor belt in accordance with said height.

5. An envelope feeder as claimed in claim 1, further comprising refill pile supervision means for supervising the height of the refill pile and emitting a signal when said height drops below a predetermined value.

* * * * *